US005871435A

United States Patent [19]

Numata et al.

[11] Patent Number: 5,871,435

[45] Date of Patent: Feb. 16, 1999

[54] CENTRIFUGE MANAGEMENT SYSTEM

[75] Inventors: Satoshi Numata; Hiroyuki Takahashi; Koji Unno, all of Ibaraki, Japan

[73] Assignee: Hitachi Koki Co., Ltd., Tokyo, Japan

[21] Appl. No.: 735,407

[22] Filed: Oct. 22, 1996

[30] Foreign Application Priority Data

Oct. 26, 1995 [JP] Japan ..... 7-278979

[51] Int. Cl.[6] ..... B04B 13/00

[52] U.S. Cl. ..... 494/7; 494/10

[58] Field of Search ..... 494/1, 16, 7–12, 494/20, 84, 85; 422/72; 210/85

[56] References Cited

U.S. PATENT DOCUMENTS 3,480,207 11/1969 Strohmaier ..... 494/10

FOREIGN PATENT DOCUMENTS 431645 6/1991 European Pat. Off. ..... 494/7

2240496 8/1991 United Kingdom ..... 494/7

*Primary Examiner*—Charles E. Cooley

*Attorney, Agent, or Firm*—Sughrue, Mion, Zinn, Macpeak & Seas, PLLC

[57] ABSTRACT

A processor (9) within an apparatus for managing a centrifuge by operation results (8) identifies an ID card of a user who operates a centrifuge (1) through a card reader (12). Further, a rotation signal (7) that will serve as operation result data of the centrifuge is received through a counter (10), and a rotation start time and a rotation stop time of a drive section (3) are read by a real-time clock. Still further, the processor (9) calculates the operation result data, displays the calculated data on a display section (16), stores the operation result data in a memory (15), and outputs the operation result data to a printer (13) as may be required by the user.

21 Claims, 3 Drawing Sheets

FIG. 3

(PRINTER OUTPUT A)

```
** * * * * * * * * * * * *
      USER LOG
** * * * * * * * * * * * *
1995-08-18   10:47
USER ID   0001

DATE        TIME    REV.
yy-mm-dd    h:m     XE04
95-08-01    0:02    20
95-08-04    0:15    150
95-08-10    2:00    120

TOTAL       2:17    290XE04
```

(PRINTER OUTPUT B)

```
** * * * * * * * * * * * *
      MACHINE LOG
** * * * * * * * * * * * *
1995-08-18   10:47

USER        REV.
ID          XE04      (%)
0001        290       3.5
0002        30        0.4
0003        1050      12.9
0004        800       9.8
0005        6000      73.4

TOTAL       8170XE04
```

CENTRIFUGE MANAGEMENT SYSTEM

BACKGROUND OF THE INVENTION

1. Field of the Invention

The invention relates to a method and apparatus of managing a centrifuge by users and operation results through identification codes such as ID cards.

2. Description of the Related Art

The operation of a centrifuge is generally managed in terms of the life of a drive section that rotates the rotor thereof. More specifically, the integrated number of rotations obtained by integrating rotation signals of the drive section is indicated as the life of the drive section. When the integrated number of rotations exceeds a predetermined value, the drive section reaches its life, so that it is the integrated number of rotations that serves as a standard for replacing the drive section. Further, users of a centrifuge are managed by allowing each user to operate the centrifuge after the user has inputted a four-digit number from a switch arranged on an operation panel that specifies operating conditions (number of rotations, accelerating and decelerating times, operating time, temperature, etc.) of a centrifuge in some high-function centrifuges.

The conventional method of managing the centrifuge by operation results whereby the integrated number of rotations obtained from a device attached to the centrifuge main body is displayed is intended to manage the centrifuge in terms of the life of the drive section, and therefore is not designed to manage the centrifuge by users.

SUMMARY OF THE INVENTION

The present invention has been made in view of the above, and therefore an object of the invention is to manage the centrifuge by users, in addition to managing the centrifuge by total operation results.

More specifically, the invention attempts to achieve the following objects.

(1) To provide operation result data by users that divides expenses to be borne for replacement of the drive section from the operation results by users when the drive section is required to be replaced by judging life of the drive section from the total operation result of the centrifuge.

(2) To provide data such as user, integrated number of rotations, drive section rotation start time, drive section operating time, and drive section rotation stop time for locating an operation during which the centrifuge is contaminated when the centrifuge has been contaminated by biological and chemical substance.

To indicate the integrated number of rotations does not allow the above objects to be achieved because of deficiency of data. The inputting of a four-digit number from the switch on the operation panel does not permit registration of such four-digit number for identification, which does not allow the centrifuge to be managed by users. That is, any user of the centrifuge is allowed to operate the centrifuge as long as he or she inputs the four-digit number. Thus, the method whereby the user is identified by the four-digit number inputted from the operation panel for identification has imposed the problem that such user of the centrifuge cannot be specified correctly. Since the operation result data is not complete objects (1) and (2) of the apparatus have not been achieved with reliable results.

The above object can be achieved by providing an apparatus for managing a centrifuge by operation results that uses an identification (ID) card which is assigned to a user and in which an identification code is stored as a means for identifying the user of a centrifuge. The apparatus using a memory such as an EEPROM as a means for storing operation results of the centrifuge, and uses a processor as a means for calculating the operation results stored in the storage means. This apparatus has a card reader to identify a user that not only detects the presence of a card but also reads an identification code stored in the card when the user of the centrifuge has inserted his or her ID card into the apparatus. When there is no card inserted, the processor within the apparatus disconnects a start switch or a door switch that controls the starting of the rotation of the drive section of the centrifuge main body. From this moment on, the user cannot activate the drive section even if he or she presses the start switch; i.e., use of the centrifuge is prohibited. It is after the ID card has been inserted that the user can activate the drive section by pressing the start switch of the centrifuge.

The apparatus first reads the code stored in the ID card, then reads from the memory the integrated number of rotations that is deemed to be an operation result as classified by the code, and displays the read data to the display section of the apparatus. When the user presses the start switch, the drive section starts rotating. The processor recognizes that the drive section has started rotating with a rotation signal of the drive section having been inputted through the counters and reads the drive section rotation start time as data by the real-time clock incorporated in the apparatus.

Further, the processor adds the number of operation signals to the integrated number of rotations that is continued in the operation result data up to the current time. When the rotation signal is no longer sent, the processor recognizes that the drive section has stopped rotating, and writes the drive section stop time to the memory as data. As a result of a series of operations, the centrifuge is managed by users, integrated numbers of rotations, drive section rotation start times, drive section rotating times, and drive section rotation stop times.

In addition, the user can produce printouts by transmitting the data stored in memory to the printer arranged in the apparatus as he or she may so require.

The printer can output data in the following formats: (a) operation result data by users as classified by the identification code stored in the ID card; (b) ratio of operation results by users with respect to the total operation result of the centrifuge; and (c) chronologically arranged operation result data of the centrifuge.

BRIEF DESCRIPTION OF THE DRAWINGS

The above and other objects and features of the present invention will be more apparent from the following description taken in conjunction with the accompanying drawings.

FIG. 3 is a diagram showing output formats of a printer in the invention.

DETAILED DESCRIPTION OF THE PREFERRED EMBODIMENTS

Now, a description will be given in more detail of an embodiment of the invention with reference to the accompanying drawings.

Figure 1:
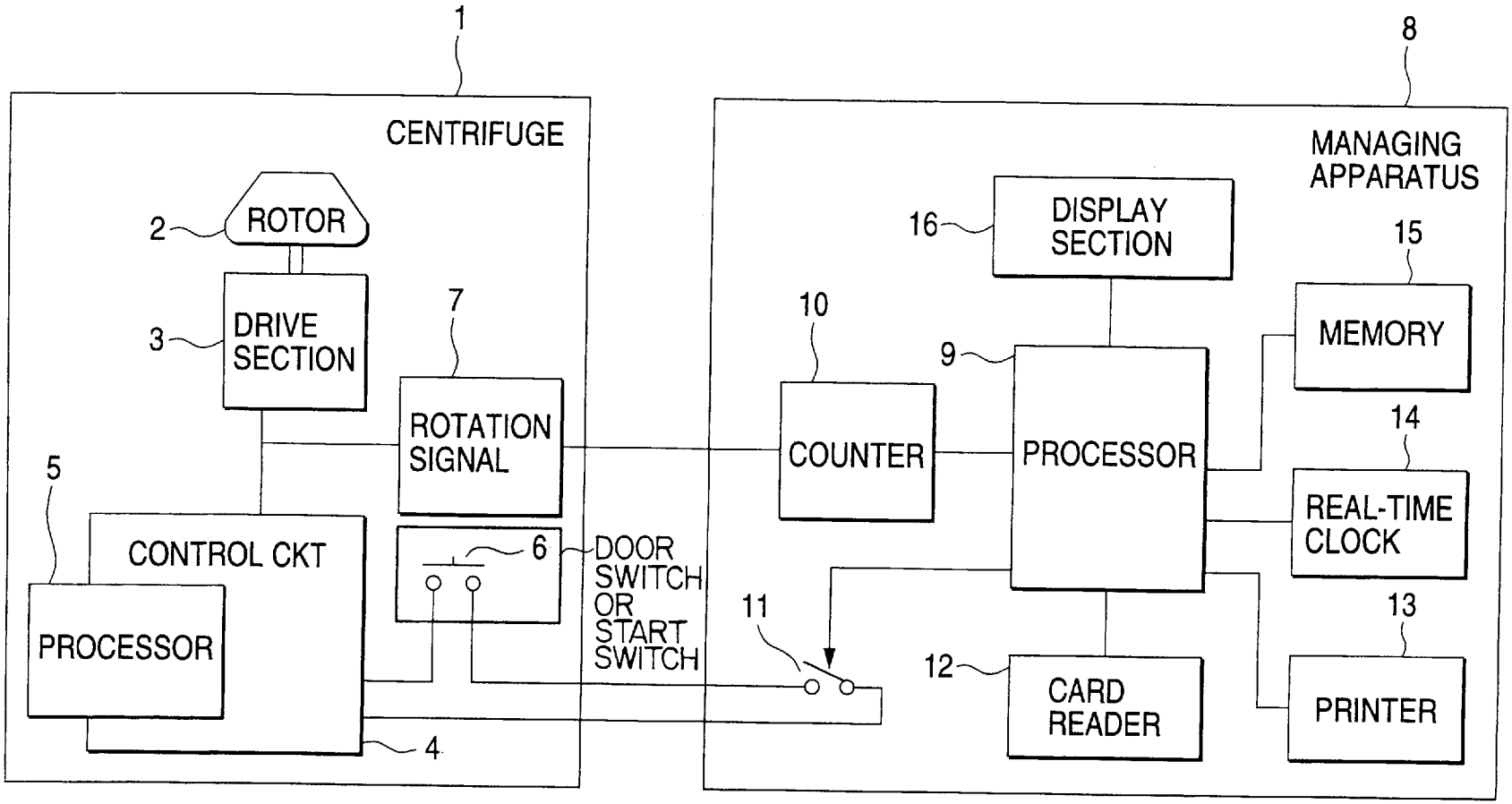
FIG. 1 is a diagram showing a general construction of a centrifuge, which is an embodiment of the invention.
Figure 2:
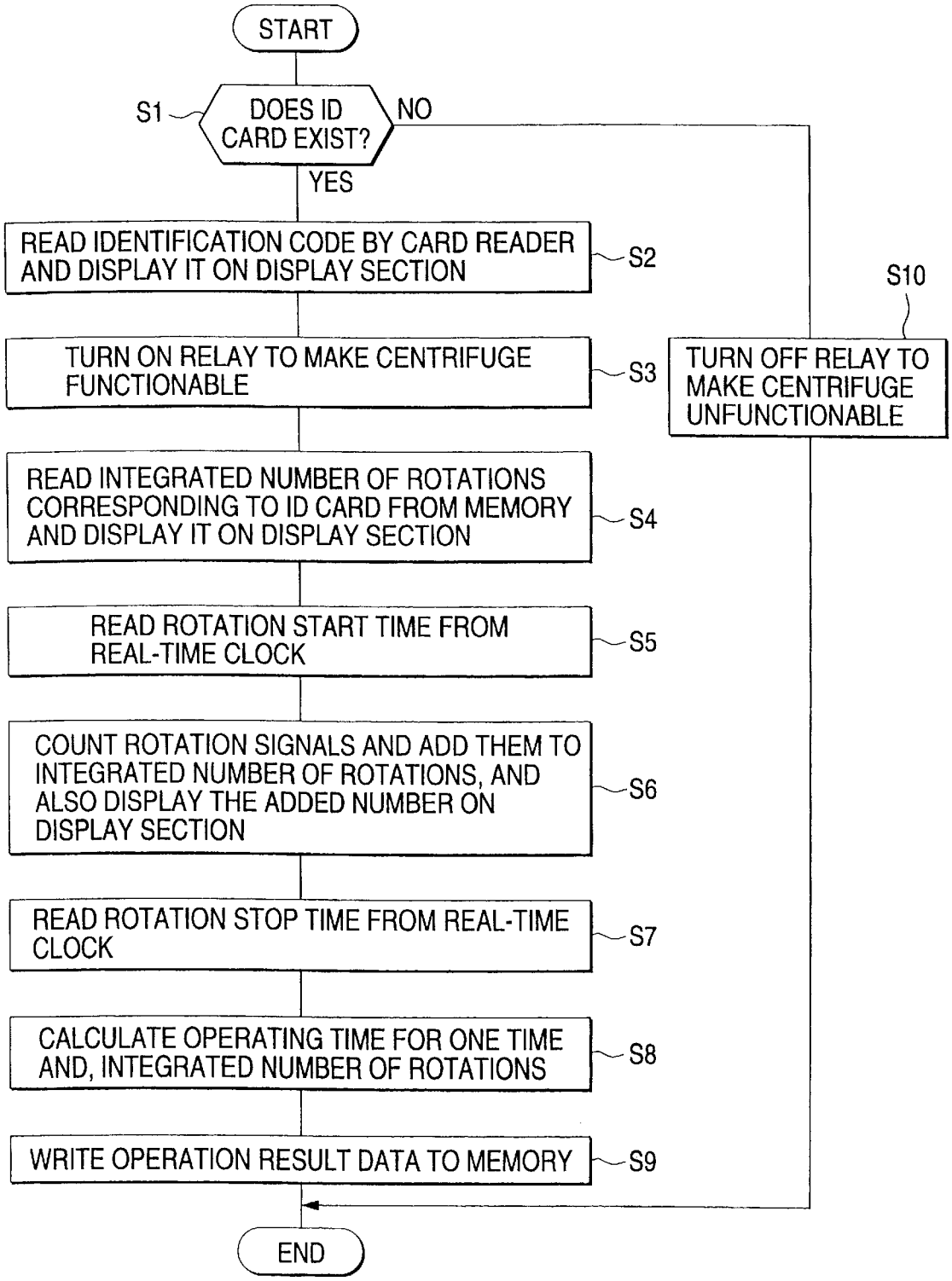
FIG. 2 is a flowchart showing an operation of an apparatus for managing the centrifuge by operation results of the invention.

FIG. 1 is a diagram showing a general construction of a centrifuge, which is an embodiment of the invention; and FIG. 2 is a flowchart showing an operation of an apparatus for managing a centrifuge by operation results of the invention (hereinafter referred to as the management apparatus).

In FIG. 1, a rotor 2 with substances charged thereinto is rotated by a drive section 3. The drive section 3 is activated to rotate by a start switch 6 having been turned on and is controlled by a control circuit 4. An apparatus 8 for managing the centrifuge 1 by operation results always checks that an ID card has been inserted thereinto through a card reader 12 (Step S1). If no ID card has been inserted, a processor 9 breaks a signal line of the start switch 6 through a relay 11, so that the centrifuge 1 will not be operated even if a user of the centrifuge 1 attempts to rotate the drive section 3 since the start switch 6 has been disabled (Step S10). Upon insertion of an ID card, the processor 9 detects the ID card, an identification code stored in the ID card is read by the card reader 12, and then displayed on a display section 16 (Step S2). The signal line of the start switch 6 is connected through the relay to thereby make the start switch functional (Step S3). Then, an integrated number of rotations serving as operation result data as classified by ID codes is read from a memory 15 (Step S4). The displayed ID code is converted into an integrated number of rotations. After the ID card has been inserted, the user presses the start switch 6 to activate the drive section 3 to rotate.

When the drive section 3 has started rotating, the number of pulses of a rotation signal 7 proportional to the number of rotations of the drive section 3 are transmitted to the operation result supervising apparatus from the centrifuge main body. The processor 9 inputs a count of the rotation signal through a counter 10. The processor 9 recognizes rotation start of the drive section 3 upon input of the rotation signal 7, and writes and stores rotation start time of the drive section 3 as the operation result data through a real-time clock 14 upon input of the rotation signal 7 (Step S5). While the centrifuge 1 is performing a series of operations such as acceleration, stabilization, and deceleration, the processor 9 adds the number of pulses of the rotation signal from the drive section 3 to the integrated number of rotations as the operation result data, and displays the integrated number of rotations on the display section 16 consecutively (Step S6). Upon stopping the drive section 3, the rotation signal 7 from the drive section 3 is no longer inputted, which in turn allows the processor 9 to recognize rotation stop of the drive section 3. The rotation stop time of the drive section 3 is written to and stored in the memory 15 by the real-time clock as the operation result data (Step S7).

Further, the operating time of the centrifuge 1 as an interval between the rotation start time and rotation stop time is calculated (Step S8). The operating time and an increase in the integrated number of rotations within the operating time are written to and stored in the memory 15 as the operation result data for a single round of operation (Step S9). As a result of the aforementioned operations, identification code, the rotation start time of the drive section 3, the rotation stop time of the drive section 3, the operating time of the drive section 3, and integrated number of rotations of the drive section 3, which serve as the operation result data of the centrifuge 1 by operations of the centrifuge 1, can be stored in the memory 15.

Further, the integrated numbers of rotations which serve as total operation result data by identification codes can be stored in the memory 15. The user of the centrifuge 1 and the manager of the centrifuge 1 can manage the centrifuge 1 by recording the operation result data stored in the memory 15 while transmitting such data to a printer 13 of the apparatus if necessary. An output format of the printer 13 can be designed so as to serve a desired purpose by allowing the processor 9 to select, calculate, combine, and array the data stored in the memory 15. Specific examples of printouts are shown in FIG. 3. The following is a modified embodiment of the invention.

As shown in FIG. 1 the management apparatus is connected to the centrifuge 1 through two signals, the rotation signal 7 and the start switch signal. That is, the number of signals is minimized to facilitate the management of the centrifuge 1 by operation results, if this method is employed, the centrifuge 1 can be managed by operation results merely by increasing the number of management apparatuses without having to make modifications on the part of the centrifuge main body. However, if some modification is allowed to be made on the part of the centrifuge main body, then a line through which a processor 5 in the controller 4 of the centrifuge 1 communicates with the processor 9 within the operation result supervising apparatus 8 may be arranged in place of the counter 10 and the relay 11, both serving to share the signals, so that the centrifuge 1 can be managed by operation results.

As described above, according to the invention, a user of the centrifuge 1 is identified by an ID card, so that the rotation start time, operating time, rotation stop time, and integrated number of rotations of the drive section 3 can be stored as operation result data of the centrifuge 1 by identification codes. Therefore, the centrifuge 1 can be simply managed by operation results.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A centrifuge for separating substances charged into a rotor by causing a drive section to rotate the rotor, said centrifuge comprising:

an identifying means for identifying a user;

a storage means for storing operation results of the said centrifuge, said operation results being classified by user as identified by said identifying means; and a calculating means for calculating said operation results stored in said storage means.

2. A centrifuge according to claim 1, wherein said identifying means identifies the user by reading an identification code stored in an identification card.

3. A centrifuge according to claim 1, wherein said calculating means comprises:

a means for determining said operation result results stored in said storage means that correspond to a particular user as identified by said identifying means; and, a means for adding said operation results of said centrifuge to said operation results determined by said determining means.

4. A centrifuge according to claim 1, wherein said calculating means comprises means for calculating a total operation result of the operation results stored in said storage means as classified by the identification of said user.

5. A centrifuge according to claim 1, wherein said operation results included data regarding operations that have an effect on the life of said centrifuge.

6. A centrifuge according to claim 1, wherein said operation results include user identification, number of rotations of the rotor, drive section rotation start time, drive section operating time and drive section rotation stop time.

7. A centrifuge for centrifugally separating substances by giving centrifugal force to the substances, comprising:

a drive section rotating at a high speed;

a switch for controlling drive start of said drive section;

a control section for controlling said drive section based on a signal from said switch;

an identifying means for identifying a user;

a management apparatus for managing said centrifuge by employing operation results, said operation results being classified by user as identified by said identifying means;

a processor for controlling the turning on and off of a signal between said switch and said control section based on a signal from said identifying means;

a storage means for storing said operation results of said centrifuge by classification as identified by said identifying means.

8. A centrifuge according to claim 7, wherein said identifying means identifies the user by reading an identification code stored in identification card.

9. A centrifuge according to claim 8, wherein said storage means is located on said identification card.

10. A centrifuge according to claim 7, wherein said switch comprises a start switch for starting said drive section to rotate.

11. A centrifuge according to claim 7, wherein said switch comprises a door switch to be controlled by opening and closing a door of said centrifuge.

12. A centrifuge according to claim 7, wherein said operation results include an operating time obtained by causing the processor to calculate an interval between a rotation start time of said drive section and a rotation stop time of said drive section.

13. A centrifuge according to claim 7, wherein said operation results include data regarding operations that have an effect on the life of said centrifuge.

14. A centrifuge according to claim 7, wherein said operation results include user identification, number of rotations of the drive section, drive section rotation start time, drive section operating time and drive section rotation stop time.

15. A system for managing a centrifuge comprising:

a centrifuge for centrifugally separating substances by giving centrifugal force to the substances, said centrifuge further comprising:

a drive section rotating at a high speed;

a switch for controlling drive start of said drive section;

a control section for controlling said drive section based on a signal from said switch;

an identifying means for identifying a user;

a management apparatus for managing said centrifuge by employing operation results, said operation results being classified by user as identified by said identifying means;

a processor for controlling the turning on and off of a signal between the switch and the control section based on a signal from said identifying means; and storage means for storing said operation results of said centrifuge by classification as identified by said identifying means; and said system for managing said centrifuge further comprises;

a unit for managing said centrifuge, said managing unit comprising a display section for displaying said operation results through an output from said processor.

16. A system according to claim 15, wherein said managing unit includes a printer attached thereto and transmits the operation results to said printer through said processor.

17. A system according to claim 15, wherein the operation results include an integrated number of rotations resulting from the operation of said drive section.

18. A system according to claim 17, wherein said integrated number of rotations is calculated by adding a rotation signal from said drive section to said operation results, wherein said operations results are stored in said storage means by classification as identified by said identifying means.

19. A system according to claim 15, wherein said operation results are a drive section rotation start time and a drive section rotation stop time.

20. A system according to claim 15, wherein said operation results includes data regarding operations that have an effect on the life of said centrifuge.

21. A system according to claim 15, wherein said operation results include user identification, number of rotations of the drive section, drive section rotation start time, drive section operating time and drive section rotation stop time.

* * * * *